US005794908A

United States Patent [19]

East et al.

[11] Patent Number: 5,794,908

[45] Date of Patent: Aug. 18, 1998

[54] WHEELCHAIR FISHING PIVOT

[75] Inventors: Garvin Lane East, Caruthers, Calif.; Johnnie Bruce Scott, III, Arlington, Va.

[73] Assignee: Paralyzed Veterans of America, Washington, D.C.

[21] Appl. No.: 909,873

[22] Filed: Aug. 12, 1997

Related U.S. Application Data

[60] Provisional application No. 60/024,040 Aug. 15, 1996.

[51] Int. Cl.[6] ..... A47B 97/00

[52] U.S. Cl. ..... 248/503.1; 248/131; 403/59

[58] Field of Search ..... 248/503.1, 131, 248/144, 145, 415, 521; 403/59, 156, 74; 280/304.1

[56] References Cited

U.S. PATENT DOCUMENTS

| | | | |
|---|---|---|---|
| 3,955,847 | 5/1976 | Schiowitz | 248/505 |
| 4,389,056 | 6/1983 | Tenniswood | 280/304.1 |
| 4,415,056 | 11/1983 | Smith . | |
| 4,455,046 | 6/1984 | Linderoth . | |
| 4,457,551 | 7/1984 | Anthony . | |
| 4,620,686 | 11/1986 | Conant | 248/415 |
| 4,623,289 | 11/1986 | Apostolos | 380/304.1 |
| 4,671,713 | 6/1987 | Lenkman . | |
| 4,690,364 | 9/1987 | Constantin | 248/503.1 |
| 4,730,964 | 3/1988 | Joyner | 280/304.1 |
| 4,754,946 | 7/1988 | Constantin | 248/503.1 |
| 4,759,684 | 7/1988 | Lanzillotta et al. | 414/678 |
| 4,789,361 | 12/1988 | Fawcett | 248/415 |
| 4,973,022 | 11/1990 | Mayland | 248/503.1 |
| 4,979,458 | 12/1990 | Bouza | 114/363 |
| 5,220,116 | 6/1993 | Sheets | 42/94 |
| 5,344,265 | 9/1994 | Ullman et al. . | |
| 5,391,030 | 2/1995 | Lee | 410/12 |

*Primary Examiner*—Ramon O. Ramirez

*Attorney, Agent, or Firm*—Oblon, Spivak, McClelland, Maier & Neustadt, P.C.

[57] ABSTRACT

A method and apparatus for pivotably mounting a wheelchair to a platform includes a pivot assembly pivotally connected onto the platform, the assembly including a connecting mechanism releasably interconnecting a portion of the wheelchair with a platform wherein the connecting mechanism includes a universal joint yoke, a quick release universal joint coupler and a quick release pin interconnecting the yoke with the coupler wherein the yoke is connectable to the connecting mechanism and the coupler is connectable to the portion of the wheelchair. The portion of the wheelchair which cooperates with the coupler may be either a frame portion thereof or an axle of the wheelchair or vice-versa. The quick release pin permits easy connecting or disconnecting of the wheelchair to the pivot assembly and the pivot assembly allows for a 360° freedom of motion of the wheelchair about the pedestal of the pivot assembly.

11 Claims, 3 Drawing Sheets

WHEELCHAIR FISHING PIVOT

This application is based on provisional patent application Ser. No. 60/024,040 filed Aug. 15, 1996.

BACKGROUND OF THE INVENTION

1. Field of the Invention

The present invention is directed to a method and apparatus for pivotally mounting a wheelchair to a platform, such as the deck of a boat, which includes a pivot assembly rotatably mounted onto the platform, the assembly including a connecting mechanism releasably interconnecting a portion of the wheelchair with a platform wherein the connecting mechanism includes a universal joint yoke, a quick release universal joint coupler and a pin interconnecting the yoke and the coupler and wherein the yoke is connectable to the connecting mechanism and the coupler is connected to a portion of the wheelchair.

2. Discussion of the Background

Wheelchair restraining devices are known, as exemplified by U.S. Pat. No. 4,754,946, U.S. Pat. No. 4,690,364 and U.S. Pat. No. 4,759,684, the disclosure of each of which is incorporated herein by reference. These patents disclose wheelchair restraining devices which are complex in nature and do not permit the flexibility of using the same attaching mechanism for attachment to either the frame or the axle of the wheelchair such that connection and release from connection can be done in a quick and easy manner. The above-noted patents and other prior art devices use a combination of structures such as hooks and latches to secure a wheelchair at several points. While apparatuses with multiple latching points have been successful in securing a wheelchair, they often require precise alignment of the wheelchair and manual dexterity on the part of the operator. Additionally, multiple latching points prevent pivoting or rotation of the wheelchair thereby limiting a passenger's ability to change viewpoints.

SUMMARY OF THE INVENTION

Therefore, an object of the present invention is to provide a pivotable mechanism which is mountable to a platform such as the deck of a boat so as to permit a 360° freedom of motion of the wheelchair about a socket base interconnecting the pivot mechanism to the platform.

The present invention has been conceived in view of the fact that sport-fishing boats are often equipped with removable pedestal seats which swivel 360° on a baseplate permanently secured to the boat deck, thereby enabling an angler sitting in a chair connected to the baseplate to fish any quadrant around the boat from such seat. An object of the present invention is to provide a wheelchair fishing pivot to instead be utilized so as to enable the wheelchair user to remove the swivel pedestal seat and attach his/her wheelchair to the baseplate and similarly fish all quadrants around the boat from such wheelchair. The wheelchair user can thus swivel about the pivot by turning either wheel and the position of the wheelchair can be locked with the wheelchair brake. A T-shaped bar with adjustable sleeves and universal joint yoke and coupler allows the wheelchair fishing pivot to be fitted to any wheelchair at either the frame or axle, and the pedestal and adjustable sleeve on the T-shaped bar allows for height adjustment. Base plates secured to the boat deck are variable in terms of sizes and dimensions and may accept a kingpin or threaded bolt of varying diameters/thread size or a plug with or without a taper and include a spring latch or other locking device. Therefore, the pedestal can be fitted with various adapters provided for attachment to various plugs or directly into different base plates. The present invention also envisions the utilization of quick release pins enabling the wheelchair to be easily released from the pivot at the universal joint, with the couplers remaining attached to the wheelchair or vice-versa.

In view of the foregoing, an object of the present invention is to provide an apparatus for pivotally mounting a wheelchair to a platform, the apparatus comprising a pivot assembly rotatably mounted on the platform, the assembly including a connecting mechanism releasably interconnecting a portion of the wheelchair with the platform wherein the connecting mechanism includes a universal joint yoke, a quick release universal joint coupler and a pin capable of rapidly interconnecting or disconnecting the yoke with a coupler wherein the yoke is connectable to the connecting mechanism and the coupler is connectable to the portion of the wheelchair.

A further object of the present invention is to provide a method of mounting a wheelchair onto a platform, which comprises pivotably mounting assembly onto the platform, releasably connecting a portion of the pivot assembly to a portion of the wheelchair by utilizing a quick release coupler and yoke and interconnecting the quick release coupler to the yoke by use of a pin member.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 2:
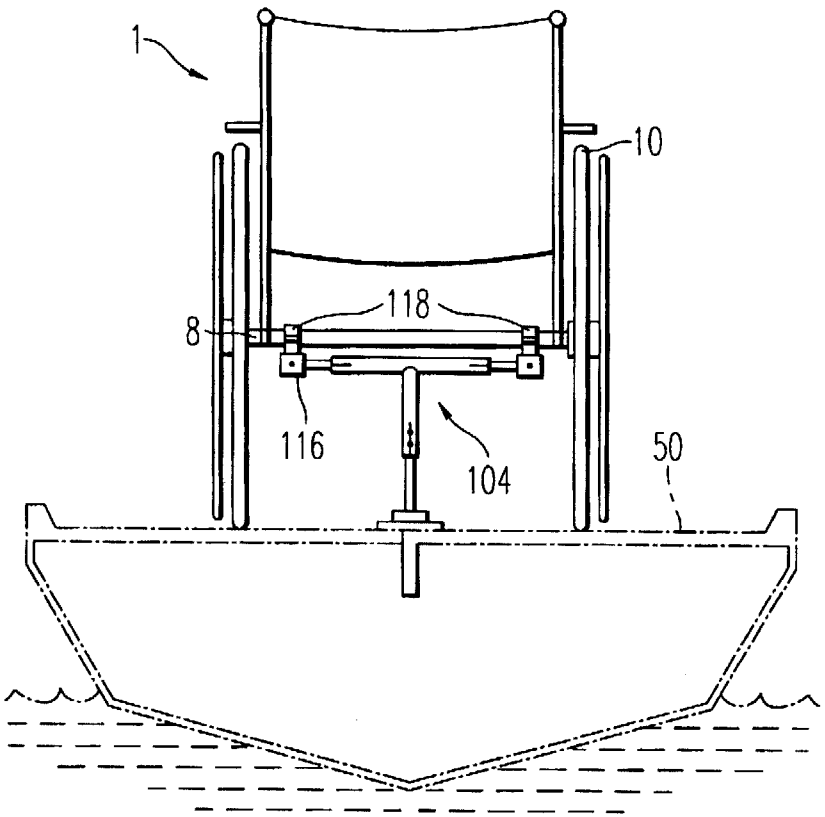
FIG. 2 illustrates the second embodiment of the invention wherein the wheelchair has a solid axle and the pivot assembly is coupled to the axle.
Figure 1:
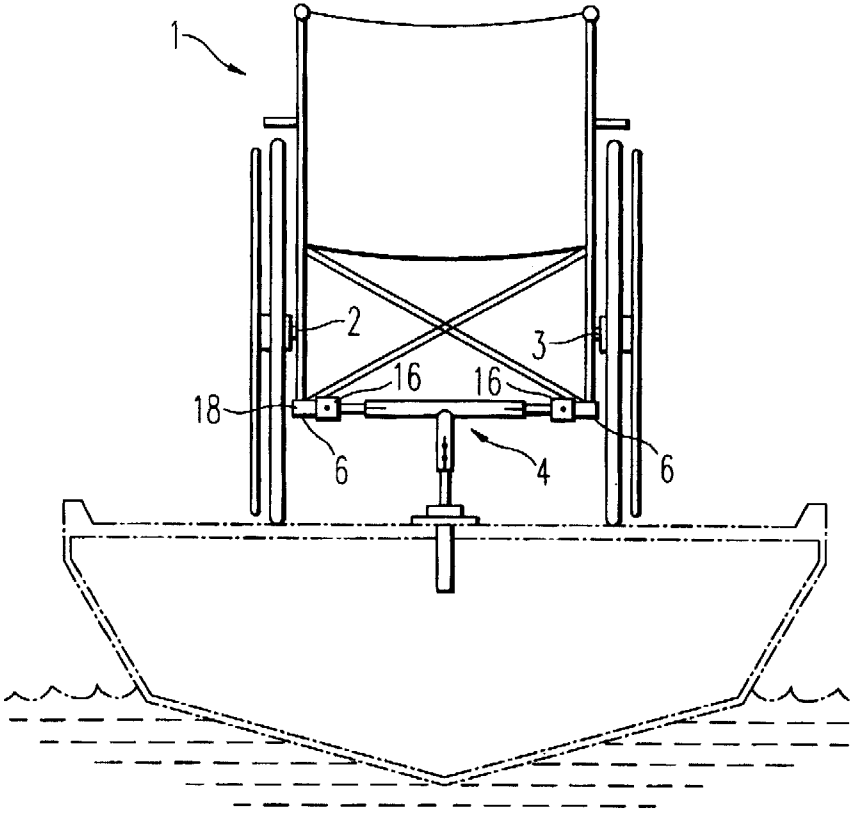
FIG. 1 is a partial cross-sectional view showing a collapsible wheelchair with split axles releasably secured to a boat deck by a pivot assembly.
Figure 3:
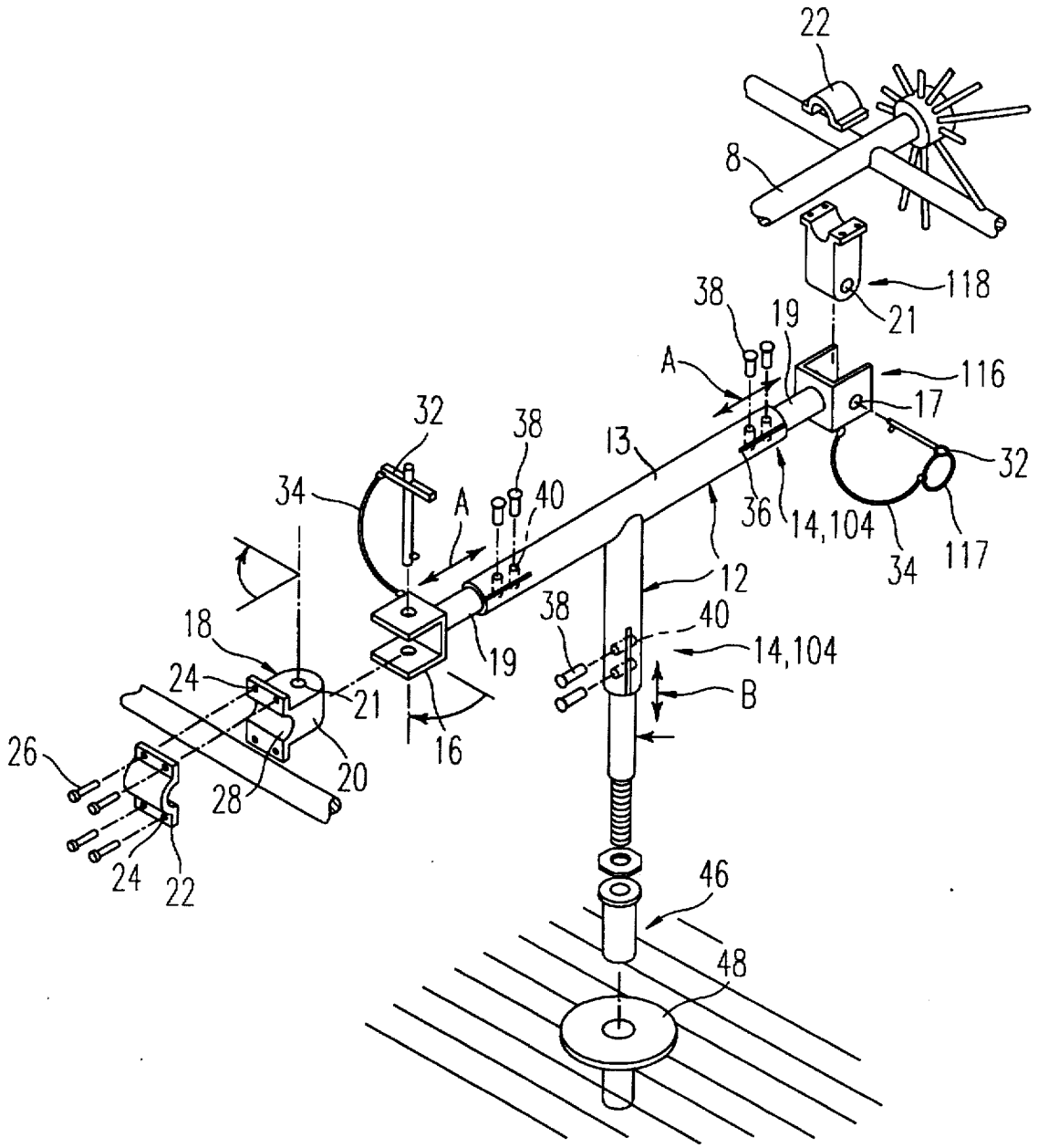
FIG. 3 shows details of the pivot assembly and the manner in which it is connectable to either the wheelchair frame or to the wheelchair axle.
Figure 4:
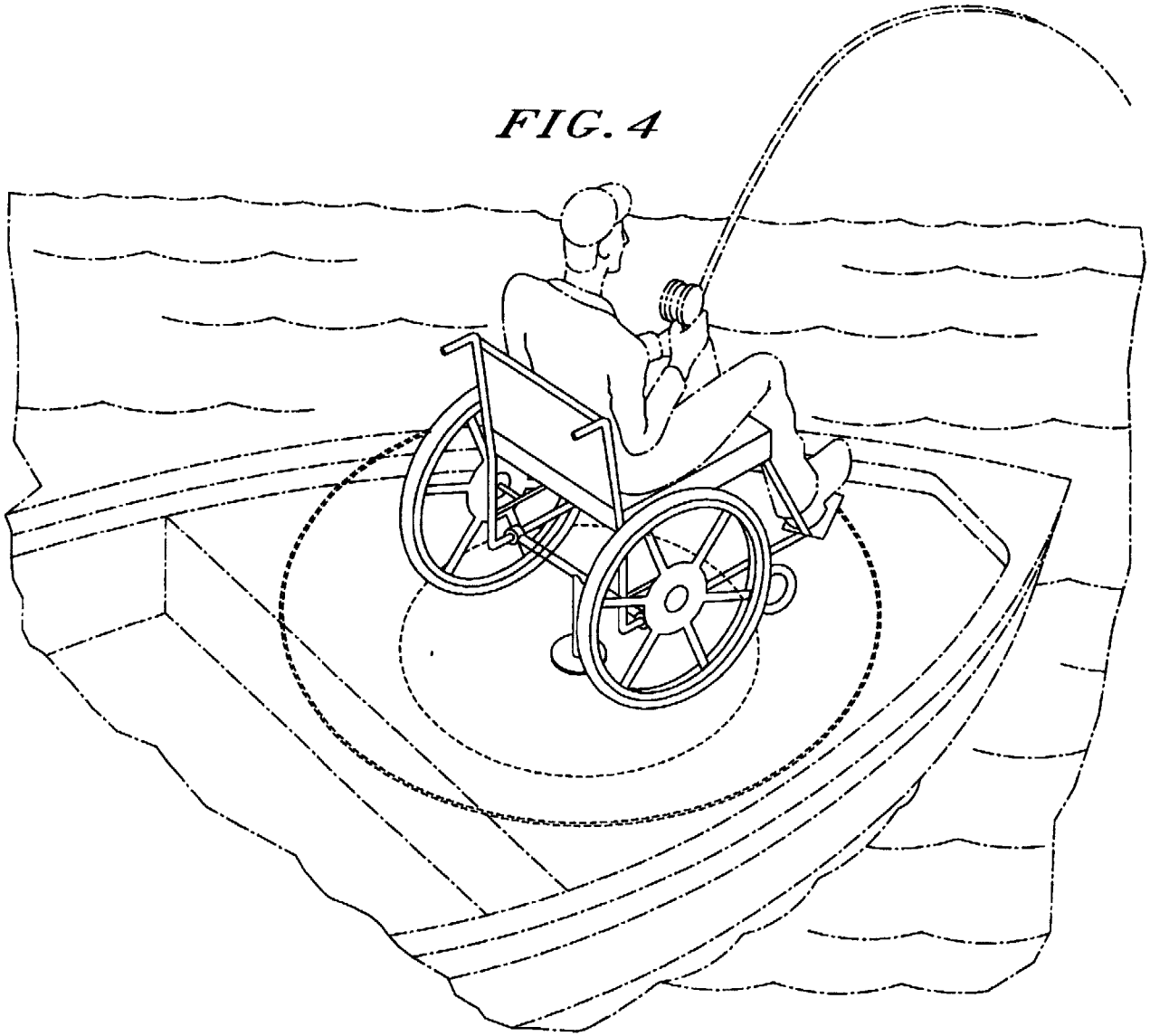
FIG. 4 is a perspective view showing the manner in which the wheelchair is pivotable 360° the pedestal of the pivot assembly on the deck of the boat.

FIGS. 1–3 illustrate details of the wheelchair and pivot assembly utilized in accordance with the present invention wherein FIG. 1 illustrates the first embodiment which utilizes a collapsible wheelchair with split axles in combination with a pivot assembly connectable to the frame of the wheelchair while FIG. 2 shows a wheelchair with a solid axle having a pivot assembly coupled to the axle.

More particularly, FIG. 1 shows a collapsible wheelchair 1 with split axles 2, 3 and a pivot assembly 4 coupled to the frame 6. The wheel 10 of the wheelchair permits the wheelchair to rotate 360° about the pivot assembly in operation of the wheelchair fishing pivot.

As shown in greater detail in FIG. 3, the T-shaped bar mechanism 12 includes horizontal bars 13 and vertical bar 15, each of which are hollow and which help form adjustable sleeves 14. Reference number 16 designates a universal joint yoke which is U-shaped and which has apertures 17 formed therein. A universal joint coupler 18 is interengageable with yoke 16. Shafts 19, 19 are respectively insertable in the horizontally oriented adjustable sleeve 14 at opposite ends thereof. The universal joint coupler 18 includes a base 20 having an aperture 21 formed therein, wherein the base is connectable to a U-shaped flange 22 to permit securing of the universal joint coupler 18 to the wheelchair frame 6.

As can be appreciated, FIG. 3 shows in the left side thereof the assembly utilized in connection with the embodiment shown in FIG. 1, with it being understood that a corresponding assembly would be provided at the opposite end of the T-bar 12 when constructing the embodiment shown in FIG. 1 to attach the T-bar to the frame 6 of the wheelchair, whereas the structure shown in the right side portion of FIG. 3 would be utilized at opposite ends of the T-bar 12 when constructing the embodiment shown in FIG. 2 which secures the universal joint coupler to the wheelchair axle 8 rather than to the wheelchair frame 6.

As also shown in FIG. 3, a plurality of apertures 24 are provided in the base 20 of the universal joint coupler and in the flange of the universal joint coupler 22 so as to permit screws/bolts/securing members to interconnect these elements. It is further noted that the coupler base 20 is provided with a U-shaped groove or recess 28 with a corresponding recess being provided in the coupler flange 22 so as to secure therebetween the wheelchair frame 6.

A quick release pin 30 is provided which permits rapid and easy interconnection of the universal joint yoke 16 with the universal joint coupler 18 (or vice-versa) and correspondingly allows for quick release by pulling on the bar member 32, said bar member 32 also assisting in the insertion of pin 30 into aperture 17 and aperture 21 when joint coupler 18 is inserted in universal joint yoke 16. A flexible connector 34 serves to interconnect the bar 32 with the universal joint yoke 16.

Designated by reference number 36 is a slit formed in the adjustable sleeve 14 so as to allow for easy sliding of the shaft 19 within sleeve 14 in the directions indicated by the arrow A. The width of the slit 36 is adjustable by use of screws/bolts which cooperate with corresponding threaded openings or securing members 40 so as to reduce or enlarge the diameter of the end portions of the sleeves 14.

Designated by reference number 42 is the pedestal of the pivot assembly, this pedestal being adjustable in an upward or downward manner in the direction of arrow B since vertical bar 15 also includes an adjustable sleeve 14 at one end thereof within which the pedestal 42 is vertically slidable. Upon tightening of the screws/bolts 38 with respect to the threaded openings or securing members 40, the sleeve can be tightened or loosened and thus permit height adjustment of the wheelchair itself so as to be easily rotatable about the pedestal 42.

Reference number 44 illustrates an adapter which is cooperable with a plug 46 so as to permit the wheelchair to be adapted for use with different sizes of plug 46 and socket base 48.

Reference number 50 designates the platform or deck of the boat while reference number 104 is utilized to designate the pivot assembly for the embodiment shown in FIG. 2, which utilizes a universal joint coupler 118 which is similar to that of coupler 18 but which is oriented in a vertical direction so as to be engageable with the wheelchair axle 8. Universal joint yoke 116 is similar in structure to that of yoke 16 used in the first embodiment. In addition, the quick release pin 32 utilizes a flexible connector 34 and a ring member 117 to permit easy insertion and removal of the pin which is used to interconnect the universal joint coupler 118 with the universal joint yoke 116.

As can thus be appreciated, the wheelchair fishing pivot permits the wheelchair user to attach the wheelchair to the socket base 48 and fish all quadrants around the boat from the wheelchair. The wheelchair user can easily swivel about the pivot assembly by turning either wheel 10 of the wheelchair and lock in position the wheelchair with a conventional wheelchair brake. The T-bar with the adjustable sleeves and universal joint yoke and universal joint coupler thus allows the pivot assembly to be fitted to any wheelchair at either the frame portion thereof or the axle portion thereof and the pedestal and adjustable sleeve on the T-bar allow for proper height adjustment. The quick release pins enable the wheelchair to be easily secured to or released from the pivot assembly at the universal joint coupler, with such couplers remaining attached to the wheelchair or being removed if so desired.

While the above-noted embodiments of the present invention have been described, it is to be understood that the present invention is not so limited insofar as various changes and modifications may be made in the invention without departing from the scope thereof.

What is claimed as new and desired to be secured by letters patent of the United States is:

1. An apparatus for pivotably mounting a wheelchair to a flat platform, comprising:

a pivot assembly pivotably mounted onto the platform, said assembly comprising:

a connecting mechanism releasably interconnecting a portion of said wheelchair with the platform wherein said connecting mechanism includes a universal joint yoke, a quick release universal joint coupler and a quick release pin interconnecting said yoke with said coupler wherein said coupler is connectable to said portion of said wheelchair.

2. An apparatus as claimed in claim 1, wherein said connecting mechanism comprises a T-shaped bar and a base into which said T-shaped bar is insertable.

3. An apparatus as claimed in claim 1, wherein said portion of said wheelchair comprises one of a frame portion and an axle member of said wheelchair.

4. An apparatus as claimed in claim 1, wherein each of said yoke and said coupler have apertures formed therein and wherein said pin member is releasably insertable into said apertures for interconnecting said yoke with said coupler.

5. An apparatus as claimed in claim 2, wherein said T-shaped bar comprises a T-shaped sleeve member and a shaft slidably positioned in said sleeve assembly, said shaft being connected to said yoke.

6. An apparatus as claimed in claim 5, wherein said sleeve assembly has at least one sleeve which has a slit formed therein adjustably slidably positioning the shaft in the sleeve and a securing member connectable to said sleeve, said securing member adjusting the width of the slit.

7. An apparatus as claimed in claim 2, wherein said T-shaped bar comprises an adjustable sleeve and a pedestal interconnecting said base and said adjustable sleeve so as to permit adjustment of the height of the wheelchair with respect to the platform.

8. A method of mounting a wheelchair onto a platform, which comprises:

pivotably mounting a pivot assembly onto the platform; and releasably connecting a portion of the pivot assembly to a portion of the wheelchair by utilizing a quick release coupler and a yoke connectable to the coupler.

9. A method as claimed in claim 8, which comprises connecting the coupler to the yoke by a quick release pin member.

10. A method as claimed in claim 8, which comprises connecting said coupler to one of frame portion of the wheelchair and an axle portion of the wheelchair by orienting the axis of the coupler in one of a substantially horizontal direction and a substantially vertical direction, respectively.

11. A method as claimed in claim 8, wherein said platform comprises a deck of a boat and which comprises adjustably mounted said pivot assembly to a base located on the deck such that, via said pivot assembly, the height of the wheelchair is adjustable.

* * * * *